United States Patent [19]

Miller et al.

[11] Patent Number: 4,663,562

[45] Date of Patent: May 5, 1987

[54] CONTRAST ENHANCEMENT STRUCTURE FOR COLOR CATHODE RAY TUBE

[75] Inventors: Gary Miller; Susan B. Jaffe, both of Binghamton, N.Y.

[73] Assignee: General Electric Company, Binghamton, N.Y.

[21] Appl. No.: 631,422

[22] Filed: Jul. 16, 1984

[51] Int. Cl.[4] ..... H01J 31/00

[52] U.S. Cl. ..... 313/478; 313/474; 358/253

[58] Field of Search ..... 313/478, 474; 358/253, 358/252

[56] References Cited

U.S. PATENT DOCUMENTS

| | | | |
|---|---|---|---|
| 2,388,203 | 10/1945 | Zindel | 358/253 |
| 3,909,524 | 9/1975 | Ohkoshi et al. | 313/478 |
| 4,245,242 | 1/1981 | Trcka | 358/253 |

FOREIGN PATENT DOCUMENTS

| | | | |
|---|---|---|---|
| 0121517 | 10/1978 | Japan | 358/252 |

OTHER PUBLICATIONS

"Kinescope Contrast Improvement in the Presence of Ambient Light", Alton J. Torre, 12/57, RCA TN No.: 61.

*Primary Examiner*—David K. Moore

*Attorney, Agent, or Firm*—I. David Blumenfeld

[57] ABSTRACT

A contrast enhancement structure for a full color cathode ray tube utilizes a combination of a louvered ambient light transmission control element in combination with a multi-notch band-pass filter. The louvered control elements provide limited viewing angles for incoming ambient light reducing light dispersion on the cathode ray phosphor surface. The multi-notch band-pass filter provides efficient spectral transmission in the phosphor emitting wavelengths. The combination of the louvered directional control elements for ambient light and a multi-notch band-pass filter matching the spectral emission characteristics of the color phosphor, substantially increases the contrast ratio. In fact, this arrangement provides contrast ratios which are of an order of magnitude larger than those previously possible.

7 Claims, 3 Drawing Figures

CONTRAST ENHANCEMENT STRUCTURE FOR COLOR CATHODE RAY TUBE

This invention relates to a color cathode ray tube display and, more particularly, relates to a means and apparatus for enhancing the contrast ratio of the color display tube.

Monochrome cathode ray tube displays are commonly used in aircraft cockpit display systems where they are subject to extremely bright ambient light conditions; ambient light conditions which, in bright sunlight, may reach 10,000 foot candles. Under such conditions, the image contrast ratio (i.e., the relative brightness of the image to that of the background areas of the display) can be relatively low, and the overall appearance and visibility of the display is poor. Image contrast enhancement techniques for monochrome CRTs have been developed involving neutral density or single wavelength band-pass filters.

Multicolor cathode ray tubes, however, produce phosphor emissions with peak wavelengths between 450 (blue) and 650 (red) nanometers. Because of the wide separation in the wavelengths of the emissions, the usual neutral density or single wavelength band-pass filter image enhancing techniques are not particularly useful since contrast ratios, when such techniques are used, are typically as low as 1.05:1 for the blue emissions, 1.1:1 for the red emissions and 1.3:1 for the green emissions. These very small differences in brightness between the display and the background are extremely troublesome, because in high ambient light conditions one can barely distinguish between the background and the display.

Applicant has found that the contrast ratio in the three spectral emission ranges of interest (red, green and blue) can be substantially enhanced to produce contrast ratios ranging from 6.1:1 (blue) to 20:1 (green) by utilizing a combination of an ambient light control element taking the form of a directional filter in combination with a multi-notch filter. The directional filter reduces the off-axis angle of view thereby eliminating a substantial portion of the incoming ambient light while the multi-notch filter enhances transmission in the wavelengths of interest. The spectral transmittance characteristics of the multi-notch filter have several peaks which register closely with the three emissions (red, blue and green) of the phosphor materials in a typical color CRT. The combination of:

(1) a directional filter which reduces the amount of background light impinging on the CRT;

(2) the selective spectral transmittance characteristics of the notch filter which favors color versus the ambient white light; and (3) the fact that the ambient light passes through the contrast enhancing structure twice results in substantial enhancement of the contrast ratio even in extremely high light situations.

The complete contrast enhancing directional/notch filter elements are attached or laminated to each other and to the CRT face plate using optically clear silicone elastomer adhesives. The use of optically clear, silicone elastomer adhesives between the elements of the assembly and the face plate of the CRT results in a number of important advantages which may be enumerated as follows:

A. The elastomer optically transmitting adhesive provides a geometric transition between the CRT surface and the flat louver filter structure thereby minimizing the cost and complexity of the contrast enhancing assembly.

B. It minimizes internal reflections by avoiding large changes in indices of refraction; i.e., large mismatches; because much closer matching of the refraction indices is possible by this means than is possible with air/glass or air/plastic interfaces.

C. The adhesive allows ready attachment of the contrast enhancing structure to the face of the CRT display.

D. The optical adhesive provides a compatible medium to laminate the individual filter elements to each other.

The transmission characteristics of the multi-notch didymium filter have several peaks which register closely with the three spectral emissions of the CRT color phosphor materials. P22 (red, blue) and P43 (green) which respectively have major peaks at 630 nanometers (red), in a band centering around 450 nanometers (blue) and at 550 nanometers (green). Thus the attenuation of the ambient white light is substantially greater than that of the red, blue and gleen transmissions from the CRT, thereby enhancing the contrast ratio between the color display and the background.

The ambient light control element comprises a directional filter consisting of a pair of louvered structures. Ihe louvered structures consist of a plastic plate which contains spaced, parallel louver elements extending through the plate. The spacing and depth of louver elements establishes a viewing angle which controls the transmittance of light. Within the viewing angle or acceptance cone, ambient light is transmitted through and reflected from the CRT back out to the viewer. Ambient light outside of the acceptance cone is virtually totally attenuated. This reduces the overall ambient light, further enhancing the contrast ratio between the image and the background.

It is, therefore, a principal objective of the instant invention to provide a contrast enhancing structure for a color cathode ray tube display system in which contrast ratios substantially larger than heretofore possible are achieved.

Another objective of the invention is to provide a contrast enhancing structure for a color cathode ray tube in which the effect of ambient background light is minimized and transmittance of emissions in the color wavelengths is enhanced resulting in overall contrast ratio enhancement.

Still another objective of the invention is to provide an integral contrast enhancing arrangement for a color cathode ray tube which is structually integrated with the face of the cathode ray tube.

Yet another objective of the invention is to produce a highly effective, low cost contrast enhancement structure for color cathode ray tube device which is simple to manufacture.

Other objectives and advantages of the instant invention will be apparent as the description thereof proceeds.

The various objectives of the invention are realized in a cathode ray tube contrast enhancement structure in which a multi-notch filter having transmittance peaks corresponding generally to the emission wavelengths of the color phosphor from the CRT is combined with louvered transmission control element which limits the angle of transmittance of ambient white light to the surface of the CRT tube. These elements are bonded together and the assembly attached or laminated to the CRT face plate utilizing an optically clear, silicone elastomer adhesive which minimizes internal reflections by minimizing differences in the index of refraction between the separation medium and the contrast enhancing structure elements and the CRT face plate.

The novel features which are characteristic of this invention are set forth with particularity in the appended claims. The invention itself, however, both as to organization and method of operation, together with other objectives and advantages, may best be understood by reference to the following description taken in connection with the accompanying drawings in which:

Figure 1:
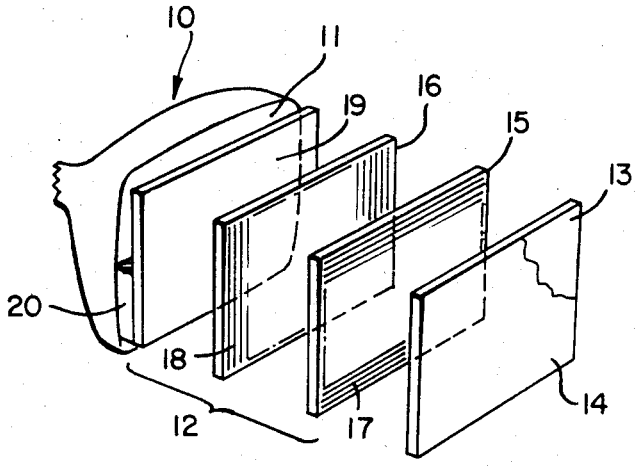
FIG. 1 is an exploded view of the elements constituting the contrast enhancing structure and the CRT face plate.

FIG. 1 shows a cathode ray tube 10 having a curved face plate 11 with contrast enhancing assembly 12, shown in exploded form, positioned in front of the face plate. The contrast enhancing assembly consists of a multi-notch, band-pass filter element 13 (preferably a didymium multi-band glass filter) having a high efficiency anti-reflective coating 14 on the front face. Positioned adjacent to multi-band filter 13 are a pair of louvered, ambient light control elements 15 and 16. The control elements are plastic plates having a plurality of parallel louvers 17 and 18 which extend through the plates. Louvers 17 and 18 are respectively oriented in the horizontal and vertical direction.

The parallel louvers establish a viewing angle along an axis normal to the surface of the plastic plate with the horizontal louvers establishing the viewing angle in the vertical plane and the vertical louvers in the horizontal plane. The combination of the two louvered plates establishes an acceptance cone in both planes. The viewing angles are a function of the louver spacing and depth; increasing the depth of the plate and louvers narrows the viewing angle whereas decreasing the depth of the plate and louvers increases viewing angle. Maximum transmittance occurs at the center of the viewing angle; i.e., zero degrees from the perpendicular to the film surface and drops off virtually linearly. Thus light outside of the viewing angle is almost totally blocked.

The horizontal parallel louver elements 17 are offset by an angle such as 15 degrees with respect to the scanning direction of the cathode ray tube in order to avoid moiré patterns between the vertical and horizontal louvers when viewing the images on the CRT. By offsetting both vertical and horizontal louvers, any possibility of moiré patterns are minimized or eliminated.

An optically clear glass plate 19 is positioned between element 16 and the face plate of the CRT. The main purpose of the optically clear glass plate is to sandwich the plastic louver elements into an integral assembly and to provide implosion protection to the CRT. The laminated assembly consisting of the didymium filter element 13, louver elements 15 and 16 and glass plate 19 are laminated to the face plate 11 of the CRT by means of an optically clear silicone adhesive 20, shown partially broken away. The clear silicone adhesive layer permits optical refraction matching between the filter assembly and the face plate. Adhesive layer 20 also acts as a geometry transition element because it conforms geometrically to the curved surface of the CRT face plate and the planar surface of the glass filter element of contrast enhancing assembly 12.

The multi-notch didymium filter, which has spectral transmission characteristics that register with the spectral emission characteristics of the phosphors, is commercially available from the Schott Optical Glass Company of Duryea, PA. The louvered ambient light control elements having horizontal and vertical louvers, respectively, are commercially available in various thicknesses and viewing angles from the Industrial Optics Division of the 3M Company of St. Paul, MN. The elastomeric, optically transparent, silicone adhesive which is used to attach the contrast enhancing structure to the face plate of the CRT may be an RTV 615 composition, available from Silicone Products Department of the General Electric Company of Waterford, NY, having a transmission of 95% and index of refraction equal to 1.406.

Figure 2:
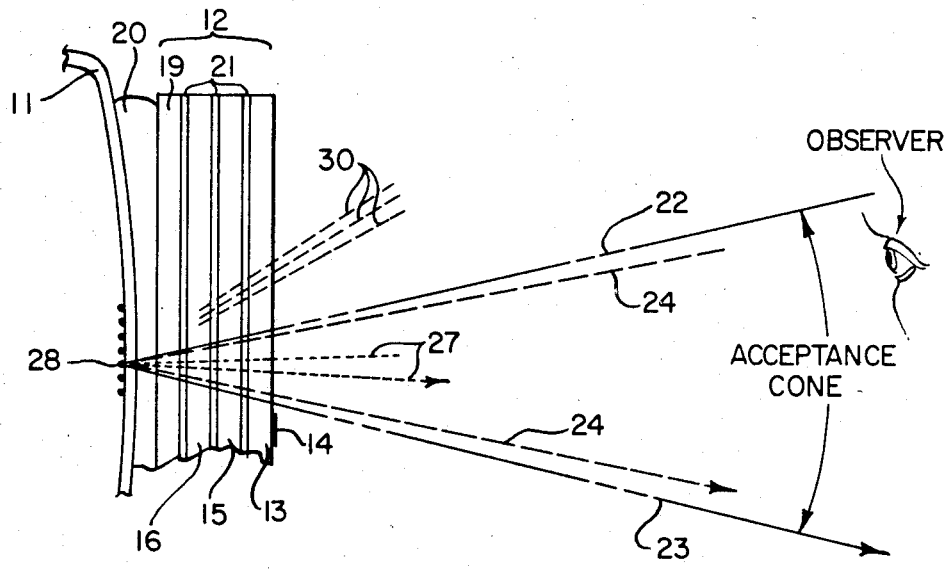
FIG. 2 shows the assembled structure and the light paths for ambient white light and for color emissions from the CRT and is useful in understanding the manner in which the system operates.

FIG. 2 shows the laminated contrast enhancing structure attached to the face plate of a color CRT. The multi-notch, band-pass filter 13, the louvered elements 15 and 16, and glass plate 19 are attached to each other by means of optical adhesive layers 21 to form a single contrast enhancing structure. The contrast enhancing structure is laminated to the CRT face plate 11 by means of an optically clear, silicone, adhesive layer 20, which conforms to the flat surface of the glass plate 19 on one side and conforms to the curved surface of CRT face plate 11 on the other. Optically clear, silicone, adhesive layer 20 is thus simultaneously a geometric transition element between the different geometric surfaces; an adhesive; and a refractive index matching element. It is, therefore, an effective and inexpensive means for laminating the constrast enhancing structure to the face of the color CRT display element to provide a unitary display and contrast enhancing structure.

FIG. 2 also shows, by means of illustrative light rays, the manner in which the contrast ratio of the CRT display is enhanced.

The lines 22 and 23 illustrate an acceptance cone of approximately 60 degrees in the vertical plane. It will be understood that a similar cone exists in the horizontal plane by virtue of the vertical louvers in control plate 16. Dashed line 24 represents a light ray within the acceptance cone of the structure which passes through the structure onto the face of the CRT and is reflected back through the structure toward the observer. Ambient light within the acceptance cone which passes through the structure twice is attenuated twice during passage. Colored light rays 27 from the CRT phosphor, illustrated schematically by phosphor dot 28, passes through the contrasting enhancing assembly only once. The contrast ratio for the CRT color display is thus enhanced both by virtue of the fact that it only passes through the structure once, as well as by the preferential spectral transmittance characteristics of didymium filter 13 for the red, blue, and green emissions from the phosphor.

Ambient light outside of the acceptance cone, as shown by the dashed lines 30, are almost completely (90% or more) blocked by the louvered elements 15 and 16. Light rays outside of the acceptance cone strike the louvers and are reflected rather than passing between the louvers.

Figure 3:
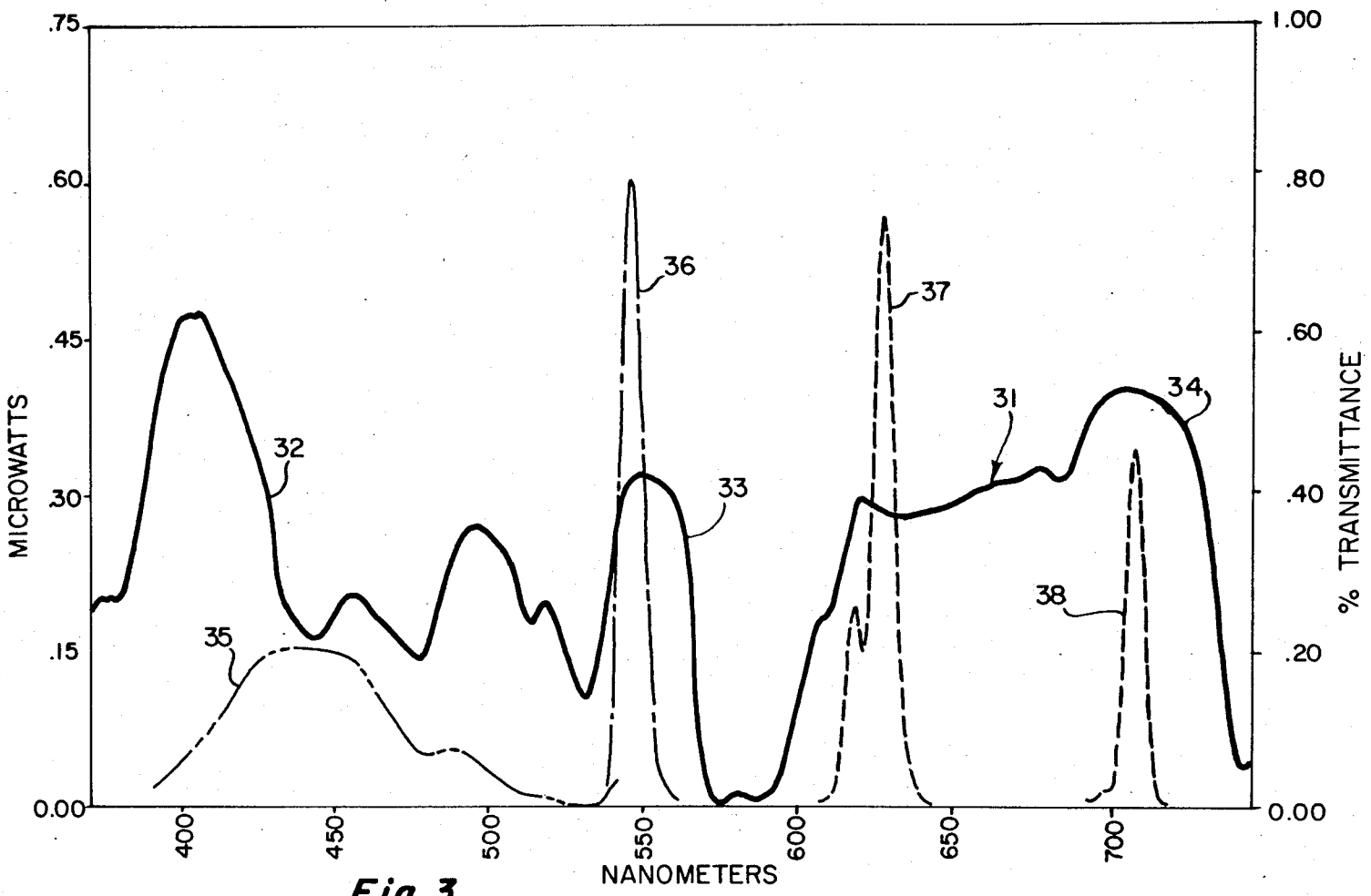
FIG. 3 illustrates the spectral transmission characteristics of the multi-notch didymium filter and the spectral emission characteristics of the phosphor.

The relationship between the blue, green, and red spectral emissions from the CRT phosphors and the spectral transmittance of the multi-notch didymium filter is illustrated graphically in FIG. 3 in which wavelength in nanometers is plotted along the abcissa. Percent transmittance for the filter and power in microwatts for the emissions are plotted along the ordinate.

The transmittance of the multi-notch didymium filter is illustrated by curve 31. As may be seen, it has three major bands 32, 33, and 34 where the transmittance is 30% or more; between 388–430 nanometers, 540–560 nanometers and 620–730 nanometers.

The spectral emission characteristics from the CRT phosphors are shown at 35 (blue), 36 (green) and 37 and 38 (red). The spectral emittances have been simplified by eliminating minor green peaks at 490 nanometers and other minor emissions for the other colors. It is clearly apparent that the red and green as well as a portion of the blue spectral emissions register closely with the spectral transmittance peaks of the didymium filter. Thus the filter preferentially transmits the color emissions from the CRT phosphors. The ambient white light is attenuated to a much greater degree (30% more than the phosphor emission during each passage through the filter. Because the ambient white light passes through the selective filter twice, the attenuation of white is so much the greater.

In discussing the directional, louvered filter forming part of the contrast enhancing structure, it should be understood that the viewing angles in the horizontal and vertical planes need not necessarily be symmetrical. The viewing angle could be greater in one direction then in the other simply by controlling the spacing and thickness of the louvered elements.

A display system utilizing an integral color CRT display contrast enhancer structure of the type previously described was constructed utilizing a 3M 60-degree directional filter, a Schott S-8802 notch filter and RTV 615 silicone adhesive to attach the contrast enhancer to the CRT face plate. The assembly was tested with a 10,000-foot candle source at 45 degrees to the phosphor surface (which is a standard measuring technique). A luminance meter was positioned with a viewing angle normal to the phosphor surface. The contrast ratios were measured for red, green and blue and found to be as follows:

| | |
|---|---|
| Red | C.R. = 8.6 |
| Green | C.R. = 19.3 |
| Blue | C.R. = 5.9 |

where C.R. = Contrast Ratio $$= \frac{\text{Apparent Image Brighness}}{\text{Apparent Background Brightness}}$$

It is therefore apparent that substantial improvement in contrast ratios for a color CRT display are realized by means of this invention.

While a particular embodiment of the invention has been shown, it will, of course, be understood that the invention is not limited thereto since many modifications, both in the structural arrangement and the instrumentalities employed, may be made. It is contemplated that the appended claims cover any such modifications as fall within the true spirit and scope of the invention.

What is claimed as new and desired to be covered by Letters Patent of United States is:

1. In a CRT display with enhanced color contrast ratio, the combination comprising:

(a) CRT display having a plurality of color display elements, (b) Contrast ratio enhancing assembly means positioned in front of and affixed to the display for preferentially transmitting blue, green and red emissions and attenuating white background light, including:

(1) directional filter means having a predetermined acceptance cone for blocking ambient white light outside of said acceptance cone and transmitting color emissions from said display and direct and reflected ambient white light within said cone, said directional filter means comprising two sets of spaced parallel light-blocking elements placed in generally orthogonal directions, wherein said sets are angularly offset from the scanning directions of the CRT to eliminate Moire patterns when viewing the CRT, (2) multi-notch filter means having higher transmittance in the blue, green, and red wave lengths whereby ambient white light is attenuated to a greater degree than said color emissions thereby enhancing the contrast ratio of the display.

2. The CRT display according to claim 1 wherein the angular offset does not exceed 15 degrees.

3. The CRT display according to claim 1 wherein said light blocking elements comprise a plurality of parallel elements extending individual plastic plates.

4. The CRT display according to claim 3 wherein said plastic plates are supported between the multi-notch filter and a glass plate.

5. The CRT display according to claim 4 wherein said plastic plates, multi-notch filter and said glass plate are affixed to each other and to the face of the CRT by an elastomeric, optically transparent adhesive having a refractive index which matches that of the other elements to eliminate multiple reflections due to refractive index mismatches.

6. The CRT display according to claim 1 wherein the notch filter has higher transmittance for spectral emissions in the 350–430, 540–560 and 620–730 nanometer bands for preferentially transmitting blue, green and red spectral emissions.

7. In a CRT display with enhanced color contrast ratio, the combination comprising:

(a) CRT display having a plurality of colored display elements, a contrast ratio enhancing assembly means including:

(1) directional filter means having a predetermined acceptance cone including two sets of spaced parallel light blocking elements placed in generally orthogonal directions, (2) multi-notch filter means having higher transmittance in the blue, green and red wave lengths whereby ambient white light is attenuated to a greater degree than the color emissions from said CRT thereby enhancing the contrast ratio of the display, (3) said directional and multi-notch filter means being affixed to each other and to the CRT by an elastomeric, optically transparent adhesive having a refractive index which matches that of the filter means to eliminate multiple reflections due to refractive index mismatches in the assembly.

* * * * *